US008733065B2

(12) United States Patent
Pervan

(10) Patent No.: US 8,733,065 B2
(45) **Date of Patent: *May 27, 2014**

(54) MECHANICAL LOCKING SYSTEM FOR FLOOR PANELS

(75) Inventor: Darko Pervan, Viken (SE)

(73) Assignee: Valinge Innovation AB, Viken (SE)

( * ) Notice: Subject to any disclaimer, the term of this patent is extended or adjusted under 35 U.S.C. 154(b) by 99 days.

This patent is subject to a terminal disclaimer.

(21) Appl. No.: 13/426,159

(22) Filed: Mar. 21, 2012

(65) Prior Publication Data

US 2012/0174520 A1 Jul. 12, 2012

Related U.S. Application Data

(63) Continuation of application No. 11/822,684, filed on Jul. 9, 2007, now Pat. No. 8,171,692, which is a continuation of application No. 10/908,658, filed on May 20, 2005, now Pat. No. 8,061,104.

(51) Int. Cl.

| | |
|---|---|
| ***E04B 1/10*** | (2006.01) |
| ***E04F 15/02*** | (2006.01) |
| ***E04F 15/04*** | (2006.01) |

(52) U.S. Cl.

CPC ..... *E04F 15/02038* (2013.01); *E04F 15/04* (2013.01)

USPC ..... 52/747.11; 52/390; 52/588.1; 52/589.1; 428/50

(58) Field of Classification Search

USPC ..... 52/578, 592.1, 592.2, 592.3, 588.1, 52/390, 392, 533, 534, 553, 582.1, 586.1, 52/586.2, 589.1, 590.2, 590.3, 52/591.1–591.5, 592.4, 745.08, 745.19, 52/747.1, 747.11, 748.1, 748.11, 539; 403/334, 345, 364–368, 372, 375, 376, 403/381; 404/34, 35, 40, 41, 46, 47, 49–58, 404/68, 70; 428/44, 47–50, 57, 58, 60, 61, 428/106, 192–194

See application file for complete search history.

(56) References Cited

U.S. PATENT DOCUMENTS

| | | | |
|---|---|---|---|
| 87,853 | A | 3/1869 | Kappes |
| 108,068 | A | 10/1870 | Utley |
| 124,228 | A | 3/1872 | Stuart |
| 213,740 | A | 4/1879 | Connor |
| 274,354 | A | 3/1883 | McCarthy et al. |

(Continued)

FOREIGN PATENT DOCUMENTS

| | | |
|---|---|---|
| CA | 991373 | 6/1976 |
| CA | 2 252 791 A1 | 5/1999 |

(Continued)

OTHER PUBLICATIONS

Pervan, Darko, U.S. Appl. No. 13/540,107, entitled "Mechanical Locking of Floor Panels with a Glued Tongue," filed Jul. 2, 2012.

(Continued)

*Primary Examiner* — William Gilbert

(74) *Attorney, Agent, or Firm* — Buchanan Ingersoll & Rooney P.C.

(57) ABSTRACT

Floor panels are provided with a mechanical locking system having small local protrusions which reduce displacement along the joint when the panels are laying flat on the sub floor and locked vertically and horizontally.

22 Claims, 8 Drawing Sheets

(56) References Cited

U.S. PATENT DOCUMENTS 316,176 A 4/1885 Ransom
634,581 A 10/1899 Miller
861,911 A 7/1907 Stewart
1,194,636 A 8/1916 Joy
1,371,856 A 3/1921 Cade
1,723,306 A 8/1929 Sipe
1,743,492 A 1/1930 Sipe
1,787,027 A 12/1930 Wasleff
1,809,393 A 6/1931 Rockwell
1,902,716 A 3/1933 Newton
1,925,070 A 8/1933 Livezey
1,995,264 A 3/1935 Mason
2,015,813 A 10/1935 Nielsen
2,026,511 A 12/1935 Storm
2,088,238 A 7/1937 Greenway
2,089,075 A 8/1937 Siebs
2,123,409 A 7/1938 Elemdorf
2,204,675 A 6/1940 Grunert
2,277,758 A 3/1942 Hawkins
2,303,745 A 12/1942 Karreman
2,430,200 A * 11/1947 Wilson ..... 52/588.1
2,596,280 A 5/1952 Nystrom
2,928,456 A 3/1955 Potchen et al.
2,732,706 A 1/1956 Friedman
2,740,167 A 4/1956 Rowley
2,805,852 A 9/1957 Malm
2,863,185 A 12/1958 Riedi
2,865,058 A 12/1958 Andersson
2,889,016 A 6/1959 Warren
2,894,292 A 7/1959 Gramelspacher
3,023,681 A 3/1962 Worson
3,077,703 A 2/1963 Bergstrom
3,099,110 A 7/1963 Spaight
3,147,522 A 9/1964 Schumm
3,200,553 A 8/1965 Frashour et al.
3,204,380 A 9/1965 Smith et al.
3,259,417 A 7/1966 Chapman
3,271,787 A 9/1966 Clary
3,282,010 A 11/1966 King, Jr.
3,325,585 A 6/1967 Brenneman
3,347,048 A 10/1967 Brown
3,377,931 A 4/1968 Hilton
3,378,958 A 4/1968 Parks et al.
3,387,422 A 6/1968 Wanzer
3,396,640 A 8/1968 Fujihara
3,436,888 A 4/1969 Ottoson
3,512,324 A 5/1970 Reed
3,517,927 A 6/1970 Kennel
3,526,071 A 9/1970 Watanabe
3,535,844 A 10/1970 Glaros
3,538,665 A 11/1970 Gohner
3,554,850 A 1/1971 Kuhle
3,572,224 A 3/1971 Perry
3,579,941 A 5/1971 Tibbals
3,720,027 A 3/1973 Christensen
3,722,379 A 3/1973 Koester
3,729,368 A 4/1973 Ingham
3,731,445 A 5/1973 Hoffman et al.
3,742,669 A 7/1973 Mansfeld
3,760,547 A 9/1973 Brenneman
3,760,548 A 9/1973 Sauer et al.
3,778,954 A 12/1973 Meserole
3,842,562 A 10/1974 Daigle
3,849,235 A 11/1974 Gwynne
3,859,000 A 1/1975 Webster
3,919,820 A 11/1975 Green
3,950,915 A 4/1976 Cole
4,007,994 A 2/1977 Brown
4,030,852 A 6/1977 Hein
4,037,377 A 7/1977 Howell et al.
4,064,571 A 12/1977 Phipps
4,080,086 A 3/1978 Watson
4,082,129 A 4/1978 Morelock
4,100,710 A 7/1978 Kowallik
4,107,892 A 8/1978 Bellem
4,113,399 A 9/1978 Hansen, Sr. et al.
4,169,688 A 10/1979 Toshio
4,196,554 A 4/1980 Anderson et al.
4,227,430 A 10/1980 Jansson et al.
4,299,070 A 11/1981 Oltmanns
4,304,083 A 12/1981 Anderson
4,426,820 A 1/1984 Terbrack et al.
4,447,172 A 5/1984 Galbreath
4,471,012 A 9/1984 Maxwell
4,512,131 A 4/1985 Laramore
4,599,841 A 7/1986 Haid
4,648,165 A 3/1987 Whitehorne
4,819,932 A 4/1989 Trotter, Jr.
4,944,514 A 7/1990 Suiter
5,007,222 A 4/1991 Raymond
5,071,282 A 12/1991 Brown
5,135,597 A 8/1992 Barker
5,148,850 A 9/1992 Urbanick
5,173,012 A 12/1992 Ortwein et al.
1,898,364 A 2/1993 Gynn
5,182,892 A 2/1993 Chase
5,216,861 A 6/1993 Meyerson
5,247,773 A 9/1993 Weir
5,253,464 A 10/1993 Nilsen
5,272,850 A 12/1993 Mysliwiec et al.
5,274,979 A 1/1994 Tsai
5,295,341 A 3/1994 Kajiwara
5,344,700 A 9/1994 McGath et al.
5,348,778 A 9/1994 Knipp et al.
5,349,796 A 9/1994 Meyerson
5,465,546 A 11/1995 Buse
5,485,702 A 1/1996 Sholton
5,502,939 A 4/1996 Zadok et al.
5,540,025 A 7/1996 Takehara
5,548,937 A 8/1996 Shimonohara
5,577,357 A 11/1996 Civelli
5,598,682 A 2/1997 Haughian
5,618,602 A 4/1997 Nelson
5,634,309 A 6/1997 Polen
5,658,086 A 8/1997 Brokaw et al.
5,671,575 A 9/1997 Wu
5,694,730 A 12/1997 Del Rincon et al.
5,695,875 A 12/1997 Larsson et al.
5,755,068 A 5/1998 Ormiston
5,797,237 A 8/1998 Finkell
5,860,267 A 1/1999 Pervan
5,899,038 A 5/1999 Stroppiana
5,950,389 A 9/1999 Porter
5,970,675 A 10/1999 Schray
6,006,486 A 12/1999 Moriau et al.
6,023,907 A 2/2000 Pervan
6,029,416 A * 2/2000 Andersson ..... 52/592.1
6,052,960 A 4/2000 Yonemura
6,065,262 A 5/2000 Motta
6,101,778 A 8/2000 Martensson
6,173,548 B1 1/2001 Hamar et al.
6,182,410 B1 2/2001 Pervan
6,203,653 B1 3/2001 Seidner
6,209,278 B1 4/2001 Tychsen
6,216,409 B1 4/2001 Roy et al.
6,254,301 B1 7/2001 Hatch
6,295,779 B1 10/2001 Canfield
6,314,701 B1 11/2001 Meyerson
6,324,809 B1 12/2001 Nelson
6,332,733 B1 12/2001 Hamberger et al.
6,345,481 B1 2/2002 Nelson
6,358,352 B1 3/2002 Schmidt
6,363,677 B1 4/2002 Chen et al.
6,385,936 B1 5/2002 Schneider
6,418,683 B1 7/2002 Martensson et al.
6,446,413 B1 9/2002 Gruber
6,449,918 B1 9/2002 Nelson
6,450,235 B1 9/2002 Lee
6,490,836 B1 12/2002 Moriau et al.
6,505,452 B1 1/2003 Hannig
6,536,178 B1 3/2003 Pålsson et al.
6,553,724 B1 4/2003 Bigler
6,576,079 B1 6/2003 Kai
6,591,568 B1 7/2003 Pålsson

(56) References Cited

U.S. PATENT DOCUMENTS 6,601,359 B2 8/2003 Olofsson
6,617,009 B1 9/2003 Chen et al.
6,647,689 B2 11/2003 Pletzer et al.
6,647,690 B1 11/2003 Martensson
6,651,400 B1 11/2003 Murphy
6,670,019 B2 * 12/2003 Andersson ..... 428/90
6,681,820 B2 1/2004 Olofsson
6,682,254 B1 1/2004 Olofson
6,685,391 B1 2/2004 Gideon
6,695,944 B2 2/2004 Courtney
6,711,869 B2 3/2004 Tychsen
6,729,091 B1 5/2004 Martensson
6,763,643 B1 * 7/2004 Mårtensson ..... 52/586.1
6,766,622 B1 7/2004 Thiers
6,769,219 B2 8/2004 Schwitte
6,769,835 B2 8/2004 Stridsman
6,786,019 B2 9/2004 Thiers
6,802,166 B1 10/2004 Gerhard
6,804,926 B1 10/2004 Eisermann
6,851,237 B2 2/2005 Niese et al.
6,854,235 B2 2/2005 Martensson
6,862,857 B2 3/2005 Tychsen
6,865,855 B2 3/2005 Knauseder
6,874,291 B1 4/2005 Weber
6,874,292 B2 4/2005 Moriau et al.
6,880,305 B2 4/2005 Pervan et al.
6,880,307 B2 4/2005 Schwitte et al.
6,898,911 B2 5/2005 Kornfalt et al.
6,898,913 B2 5/2005 Pervan
6,918,220 B2 7/2005 Pervan
6,922,964 B2 8/2005 Pervan
6,922,965 B2 8/2005 Rosenthal et al.
6,948,716 B2 9/2005 Drouin
6,955,020 B2 10/2005 Moriau et al.
6,966,963 B2 11/2005 O'Connor
7,021,019 B2 4/2006 Knauseder
7,040,068 B2 5/2006 Moriau et al.
7,051,486 B2 5/2006 Pervan
7,055,290 B2 6/2006 Thiers
7,086,205 B2 8/2006 Pervan
D528,671 S 9/2006 Grafenauer
7,108,031 B1 9/2006 Secrest
7,121,058 B2 10/2006 Palsson et al.
7,127,860 B2 10/2006 Pervan et al.
7,131,242 B2 11/2006 Martensson et al.
7,152,383 B1 12/2006 Wilkinson et al.
7,188,456 B2 3/2007 Knauseder
7,219,392 B2 5/2007 Mullet et al.
7,251,916 B2 8/2007 Konzelmann et al.
7,257,926 B1 8/2007 Kirby
7,275,350 B2 10/2007 Pervan et al.
7,328,536 B2 2/2008 Moriau et al.
7,337,588 B1 * 3/2008 Moebus ..... 52/592.4
7,356,971 B2 4/2008 Pervan
7,377,081 B2 5/2008 Ruhdorfer
7,386,963 B2 6/2008 Pervan
7,398,625 B2 7/2008 Pervan
7,441,384 B2 10/2008 Miller et al.
7,441,385 B2 10/2008 Palsson et al.
7,451,578 B2 11/2008 Hannig
7,454,875 B2 11/2008 Pervan et al.
7,484,338 B2 2/2009 Pervan et al.
7,516,588 B2 4/2009 Pervan
7,533,500 B2 5/2009 Morton
7,556,849 B2 7/2009 Thompson et al.
7,568,322 B2 8/2009 Pervan
7,584,583 B2 9/2009 Bergelin et al.
7,596,920 B2 10/2009 Konstanczak
7,603,826 B1 10/2009 Moebus
7,614,197 B2 11/2009 Nelson
7,617,651 B2 11/2009 Grafenauer
7,632,561 B2 12/2009 Thiers
7,634,884 B2 12/2009 Pervan
7,637,068 B2 12/2009 Pervan
7,677,005 B2 3/2010 Pervan
7,716,889 B2 5/2010 Pervan
7,721,503 B2 5/2010 Pervan et al.
7,726,088 B2 6/2010 Muehlebach
7,757,452 B2 7/2010 Pervan
7,802,411 B2 9/2010 Pervan
7,806,624 B2 10/2010 McLean et al.
7,841,144 B2 11/2010 Pervan et al.
7,841,145 B2 11/2010 Pervan et al.
7,861,482 B2 1/2011 Pervan et al.
7,866,110 B2 1/2011 Pervan
7,874,119 B2 1/2011 Pervan et al.
7,908,815 B2 3/2011 Pervan et al.
7,930,862 B2 4/2011 Bergelin et al.
7,954,295 B2 6/2011 Pervan
7,980,041 B2 7/2011 Pervan
8,011,155 B2 9/2011 Pervan
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,234,830 B2 8/2012 Pervan et al.
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,528,289 B2 9/2013 Pervan et al.
8,544,234 B2 10/2013 Pervan et al.
8,572,922 B2 11/2013 Pervan
2001/0024707 A1 * 9/2001 Andersson et al. ..... 428/60
2002/0007608 A1 1/2002 Pervan
2002/0007609 A1 1/2002 Pervan
2002/0031646 A1 3/2002 Chen et al.
2002/0046433 A1 4/2002 Sellman et al.
2002/0056245 A1 5/2002 Thiers
2002/0069611 A1 6/2002 Leopolder
2002/0083673 A1 7/2002 Kettler et al.
2002/0092263 A1 7/2002 Schulte
2002/0095894 A1 7/2002 Pervan
2002/0112429 A1 8/2002 Niese et al.
2002/0112433 A1 8/2002 Pervan
2002/0170257 A1 11/2002 McLain et al.
2002/0170258 A1 11/2002 Schwitte et al.
2002/0170259 A1 11/2002 Ferris
2002/0178674 A1 12/2002 Pervan
2002/0178680 A1 12/2002 Martensson
2002/0178682 A1 12/2002 Pervan
2003/0009971 A1 1/2003 Palmberg
2003/0024199 A1 2/2003 Pervan et al.
2003/0024200 A1 2/2003 Moriau et al.
2003/0037504 A1 2/2003 Schwitte et al.
2003/0084636 A1 5/2003 Pervan
2003/0094230 A1 5/2003 Sjöberg
2003/0101674 A1 6/2003 Pervan et al.
2003/0101681 A1 * 6/2003 Tychsen ..... 52/783.1
2003/0154676 A1 8/2003 Schwartz
2003/0180091 A1 9/2003 Stridsman
2003/0188504 A1 10/2003 Ralf
2003/0196397 A1 10/2003 Niese et al.
2003/0196405 A1 10/2003 Pervan
2003/0221387 A1 12/2003 Shah
2004/0031227 A1 2/2004 Knauseder
2004/0035079 A1 2/2004 Evjen
2004/0045254 A1 3/2004 Van der Heijden et al.
2004/0049999 A1 3/2004 Krieger
2004/0060255 A1 4/2004 Knauseder
2004/0068954 A1 4/2004 Martensson
2004/0107659 A1 6/2004 Glockl
2004/0123548 A1 7/2004 Gimpel et al.
2004/0128934 A1 7/2004 Hecht
2004/0139676 A1 7/2004 Knauseder
2004/0139678 A1 7/2004 Pervan

(56) References Cited

U.S. PATENT DOCUMENTS

2004/0159066 A1 8/2004 Thiers et al.
2004/0168392 A1 9/2004 Konzelmann et al.
2004/0177584 A1 9/2004 Pervan
2004/0182033 A1 9/2004 Wernersson
2004/0182036 A1 9/2004 Sjoberg et al.
2004/0200175 A1 10/2004 Weber
2004/0211143 A1 10/2004 Hannig
2004/0211144 A1 10/2004 Stanchfield
2004/0250492 A1 12/2004 Becker
2004/0261348 A1 12/2004 Vulin
2005/0028474 A1 2/2005 Kim
2005/0034404 A1 2/2005 Pervan
2005/0050827 A1 3/2005 Schitter
2005/0055943 A1 3/2005 Pervan
2005/0102937 A1 5/2005 Pervan
2005/0108970 A1 5/2005 Liu
2005/0138881 A1 6/2005 Pervan
2005/0160694 A1 7/2005 Pervan
2005/0166502 A1 8/2005 Pervan et al.
2005/0166514 A1 8/2005 Pervan
2005/0193677 A1 9/2005 Vogel
2005/0205161 A1 9/2005 Lewark
2005/0208255 A1 9/2005 Pervan
2005/0210810 A1 9/2005 Pervan
2005/0235593 A1 10/2005 Hecht
2005/0252130 A1 11/2005 Martensson
2005/0268570 A2 12/2005 Pervan
2006/0032168 A1 2/2006 Thiers et al.
2006/0070333 A1 4/2006 Pervan
2006/0075713 A1 4/2006 Pervan et al.
2006/0101769 A1 5/2006 Pervan
2006/0156670 A1 7/2006 Knauseder
2006/0236642 A1 10/2006 Pervan
2006/0260254 A1 11/2006 Pervan
2006/0283127 A1 12/2006 Pervan
2007/0006543 A1 1/2007 Engstrom
2007/0011981 A1 1/2007 Eisermann
2007/0028547 A1 2/2007 Grafenauer et al.
2007/0065293 A1 3/2007 Hannig
2007/0175143 A1 8/2007 Pervan et al.
2007/0175144 A1 8/2007 Hakansson
2007/0175148 A1 8/2007 Bergelin
2007/0175156 A1 8/2007 Pervan et al.
2008/0000179 A1 1/2008 Pervan et al.
2008/0000180 A1 1/2008 Pervan
2008/0000182 A1 1/2008 Pervan
2008/0000185 A1* 1/2008 Duernberger ..... 52/578
2008/0000186 A1 1/2008 Pervan et al.
2008/0000187 A1 1/2008 Pervan
2008/0000188 A1 1/2008 Pervan
2008/0000189 A1 1/2008 Pervan
2008/0000194 A1 1/2008 Pervan
2008/0000417 A1 1/2008 Pervan
2008/0005989 A1 1/2008 Pervan
2008/0005992 A1 1/2008 Pervan
2008/0005997 A1 1/2008 Pervan
2008/0005998 A1 1/2008 Pervan
2008/0005999 A1 1/2008 Pervan
2008/0008871 A1 1/2008 Pervan
2008/0010931 A1 1/2008 Pervan et al.
2008/0010937 A1 1/2008 Pervan et al.
2008/0028707 A1 2/2008 Pervan
2008/0028713 A1 2/2008 Pervan et al.
2008/0034701 A1 2/2008 Pervan
2008/0034708 A1 2/2008 Pervan
2008/0041007 A1 2/2008 Pervan et al.
2008/0041008 A1 2/2008 Pervan
2008/0060308 A1 3/2008 Pervan
2008/0066415 A1 3/2008 Pervan
2008/0104921 A1 5/2008 Pervan et al.
2008/0110125 A1 5/2008 Pervan
2008/0134607 A1 6/2008 Pervan et al.
2008/0134613 A1 6/2008 Pervan et al.
2008/0134614 A1 6/2008 Pervan et al.
2008/0155930 A1 7/2008 Pervan et al.
2008/0216434 A1 9/2008 Pervan
2008/0216920 A1 9/2008 Pervan
2008/0295432 A1 12/2008 Pervan et al.
2009/0133353 A1 5/2009 Pervan et al.
2009/0151291 A1 6/2009 Pervan
2009/0193748 A1 8/2009 Boo et al.
2010/0229491 A1 9/2010 Pervan
2010/0293879 A1 11/2010 Pervan et al.
2010/0300031 A1 12/2010 Pervan et al.
2010/0319290 A1 12/2010 Pervan
2010/0319291 A1 12/2010 Pervan et al.
2011/0030303 A1 2/2011 Pervan et al.
2011/0041996 A1 2/2011 Pervan
2011/0072754 A1 3/2011 Pervan et al.
2011/0088344 A1 4/2011 Pervan et al.
2011/0088345 A1 4/2011 Pervan
2011/0154763 A1 6/2011 Bergelin et al.
2011/0167750 A1 7/2011 Pervan
2011/0203214 A1 8/2011 Pervan
2011/0209430 A1 9/2011 Pervan
2011/0225922 A1 9/2011 Pervan et al.
2011/0252733 A1 10/2011 Pervan
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0151865 A1 6/2012 Pervan et al.
2012/0174515 A1 7/2012 Pervan
2012/0279161 A1 11/2012 HÅkansson et al.
2013/0008117 A1 1/2013 Pervan
2013/0014463 A1 1/2013 Pervan
2013/0019555 A1 1/2013 Pervan
2013/0042562 A1 2/2013 Pervan
2013/0042563 A1 2/2013 Pervan
2013/0042564 A1 2/2013 Pervan
2013/0042565 A1 2/2013 Pervan
2013/0047536 A1 2/2013 Pervan
2013/0081349 A1 4/2013 Pervan et al.
2013/0111845 A1 5/2013 Pervan
2013/0145708 A1 6/2013 Pervan
2013/0160391 A1 6/2013 Pervan et al.
2013/0232905 A2 9/2013 Pervan
2013/0239508 A1 9/2013 Pervan et al.
2013/0263454 A1 10/2013 Boo et al.
2013/0263547 A1 10/2013 Boo

FOREIGN PATENT DOCUMENTS

CA 2456513 A1 2/2003
CA 2 252 791 C 5/2004
CN 1270263 A 10/2000
DE 1 212 275 B 3/1966
DE 2 159 042 C3 6/1973
DE 26 16 077 A1 10/1977
DE 30 41 781 A1 6/1982
DE 33 43 601 A1 6/1985
DE 35 38 538 A1 5/1987
DE 39 18 676 A1 8/1990
DE 39 32 980 A1 11/1991
DE 41 30 115 A1 3/1993
DE 42 15 273 A1 11/1993
DE 42 42 530 A1 6/1994
DE 196 01 322 A1 5/1997
DE 198 54 475 A1 7/1999
DE 198 51 200 C1 3/2000
DE 299 22 649 U1 4/2000
DE 29922649 * 4/2000 ..... E04F 13/08
DE 199 40 837 A1 11/2000
DE 199 58 225 A1 6/2001
DE 202 05 774 U1 8/2002
DE 103 16 695 A1 10/2004
DE 203 20 799 U1 4/2005
EP 0 013 852 A1 8/1980
EP 0 652 340 A1 5/1995
EP 0 849 416 A2 6/1998
EP 0 871 156 A2 10/1998
EP 0 974 713 A1 1/2000
EP 1 045 083 A1 10/2000
EP 1 120 515 A1 8/2001

(56) References Cited

FOREIGN PATENT DOCUMENTS

| | | | |
|---|---|---|---|
| EP | 1 146 182 | A2 | 10/2001 |
| EP | 1 165 906 | A1 | 1/2002 |
| EP | 1 045 083 | B1 | 10/2002 |
| EP | 1 350 904 | A2 | 10/2003 |
| EP | 1 350 904 | A3 | 10/2003 |
| EP | 1 420 125 | A2 | 5/2004 |
| EP | 1 437 457 | A2 | 7/2004 |
| FR | 1.138.595 | | 6/1957 |
| FR | 1.293.043 | A | 5/1962 |
| FR | 2 256 807 | | 8/1975 |
| FR | 2 810 060 | A1 | 12/2001 |
| GB | 240629 | | 10/1925 |
| GB | 276352 | | 7/1932 |
| GB | 812671 | A | 4/1959 |
| GB | 1171337 | | 11/1969 |
| GB | 1 430 423 | A | 3/1976 |
| GB | 2 051 916 | A | 1/1981 |
| GB | 2 256 023 | A | 11/1992 |
| JP | 1-178659 | A | 7/1989 |
| JP | 03-110258 | A | 5/1991 |
| JP | 3-169967 | A | 7/1991 |
| JP | 05-018028 | A | 1/1993 |
| JP | 6-146553 | A | 5/1994 |
| JP | 6-288017 | A | 10/1994 |
| JP | 6-306961 | A | 11/1994 |
| JP | 6-320510 | A | 11/1994 |
| JP | 6-322848 | A | 11/1994 |
| JP | 7-180333 | A | 7/1995 |
| JP | 7-300979 | * | 11/1995 |
| JP | 7-300979 | A | 11/1995 |
| JP | 7-310426 | A | 11/1995 |
| JP | 10-219975 | A | 8/1998 |
| SE | 372 051 | B | 12/1974 |
| SE | 450 141 | B | 6/1987 |
| SE | 502 994 | C2 | 3/1996 |
| SE | 506 254 | C2 | 11/1997 |
| SE | 512 313 | C2 | 2/2000 |
| WO | WO 84/02155 | A1 | 6/1984 |
| WO | WO 93/13280 | A1 | 7/1993 |
| WO | WO 94/26999 | A1 | 11/1994 |
| WO | WO 96/27719 | A1 | 9/1996 |
| WO | WO 96/27721 | A1 | 9/1996 |
| WO | WO 97/47834 | A1 | 12/1997 |
| WO | WO 98/22677 | A1 | 5/1998 |
| WO | WO 98/38401 | A1 | 9/1998 |
| WO | WO 99/66151 | A1 | 12/1999 |
| WO | WO 99/66152 | A1 | 12/1999 |
| WO | WO 00/20705 | A1 | 4/2000 |
| WO | WO 00/20706 | A1 | 4/2000 |
| WO | WO 00/43281 | A2 | 7/2000 |
| WO | WO 00/47841 | A1 | 8/2000 |
| WO | WO 00/55067 | A1 | 9/2000 |
| WO | WO 00/66856 | A1 | 11/2000 |
| WO | WO 01/02669 | A1 | 1/2001 |
| WO | WO 01/02670 | A1 | 1/2001 |
| WO | WO 01/07729 | A1 | 2/2001 |
| WO | WO 01/48332 | A1 | 7/2001 |
| WO | WO 01/51732 | A1 | 7/2001 |
| WO | WO 01/51733 | A1 | 7/2001 |
| WO | WO 01/53628 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/98604 | A1 | 12/2001 |
| WO | WO 02/48127 | | 6/2002 |
| WO | WO 02/055809 | A1 | 7/2002 |
| WO | WO 02/055810 | A1 | 7/2002 |
| WO | WO 02/092342 | A1 | 11/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/074814 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/016877 | A1 | 2/2004 |
| WO | WO 2004/020764 | A1 | 3/2004 |
| WO | WO 2004/079130 | A1 | 9/2004 |
| WO | WO 2004/083557 | A1 | 9/2004 |
| WO | WO 2004/085765 | A1 | 10/2004 |
| WO | WO 2005/003488 | A1 | 1/2005 |
| WO | WO 2005/054599 | A1 | 6/2005 |
| WO | WO 2006/043893 | A1 | 4/2006 |
| WO | WO 2006/050928 | A1 | 5/2006 |
| WO | WO 2006/104436 | A1 | 10/2006 |
| WO | WO 2006/123988 | A1 | 11/2006 |
| WO | WO 2007/015669 | A2 | 2/2007 |
| WO | WO 2007/079845 | A1 | 7/2007 |
| WO | WO 2007/089186 | A1 | 8/2007 |

OTHER PUBLICATIONS

Pervan, Darko, U.S. Appl. No. 13/544,281, entitled "Mechanical Locking System for Floor Panels," filed Jul. 9, 2012.

Pervan, Darko, et al., U.S. Appl. No. 13/546,569, entitled "Mechanical Locking System for Floor Panels," filed Jul. 11, 2012.

Pervan, Darko, et al., U.S. Appl. No. 13/585,204, entitled "Mechanical Locking System for Floor Panels," filed Aug. 14, 2012.

Pervan, Darko, et al., U.S. Appl. No. 13/585,485, entitled "Mechanical Locking System for Floor Panels," filed Aug. 14, 2012.

Pervan, Darko, et al., U.S. Appl. No. 13/585,179, entitled, "Mechanical Locking System for Floor Panels," filed Aug. 14, 2012.

Pervan, Darko, et al., U.S. Appl. No. 13/596,988, entitled, "Mechanical Locking System for Floor Panels," filed Aug. 28, 2012.

Pervan, Darko, et al., U.S. Appl. No. 13/728,121, entitled "Mechanical Locking of Floor Panels with a Flexible Tongue," filed Dec. 27, 2012.

Boo, Christian, U.S. Appl. No. 61/620,233, entitled "Building Panel with a Mechanical Locking System," filed Apr. 4, 2012.

Boo, Christian, U.S. Appl. No. 61/620,246, entitled "Method for Producing a Mechanical Locking System for Building Panels," filed Apr. 4, 2012.

Pervan, Darko, et al., U.S. Appl. No. 13/577,042, entitled "Mechanical Locking System for Floor Panels," filed Aug. 3, 2012.

Pervan, Darko, et al., U.S. Appl. No. 13/479,607, entitled "Locking System, Floorboard Comprising Such a Locking system, As Well As Method for Making Floorboards," filed May 24, 2012.

International Search Report issued in corres. PCT/SE2006/000595 (Published as WO 2006/123988 A1), Aug. 18, 2006, Swedish Patent Office, Stockholm, SE.

International Preliminary Report on Patentability issued I corres. PCT/SE2006/000595 (Published as WO 2006/123988 A1), Aug. 21, 2007, Patent-och registreringsverket, Stockholm, SE.

Written Opinion issued in PCT/SE2006/000595 (Published as WO 2006/123988 A1), Aug. 18, 2006, Swedish Patent Office, Stockholm SE.

Correspondence from Bütec cited during opposition procedure at EPO in DE Patent No. 3343601,including announcement of Oct. 1984 re "Das Festprogram von Bütec: Mehrzweckbühnen, tanzplatten, Schonbeläge, Tanzbeläge, Bestuhlung"; letter of Nov. 7, 2001 to Perstorp Support AB with attached brochure published Oct. 1984 and installation instructions published Nov. 1984; and letter of Nov. 19, 2001 to Perstorp Support AB.

Laminate Flooring Tips (http://flooring.lifetips.com/cat/61734/laminate-flooring-tips/index.html), 12 pages Copyright 2000.

Pervan, Darko, et al., U.S. Appl. No. 13/758,603, entitled "Mechanical Locking System for Panels and Method of Installing Same," filed Feb. 4, 2013.

U.S. Appl. No. 13/479,607, Pervan et al.

Pervan, Darko, et al., U.S. Appl. No. 13/886,916, entitled "Mechanical Locking of Building Panels," filed May 3, 2013.

Boo, Christian, U.S. Appl. No. 13/855,966, entitled "Building Panel with a Mechanical Locking System," filed Apr. 3, 2013.

Boo, Christian, et al., U.S. Appl. No. 13/855,979, entitled "Method for Producing a Mechanical Locking System for Building Panels," filed Apr. 3, 2013.

Pervan, Darko, et al., U.S. Appl. No. 13/962,446 entitled "Mechanical Locking System for Floor Panels," filed in the U.S. Patent and Trademark Office on Aug. 8, 2013.

(56) References Cited

OTHER PUBLICATIONS

Pervan, Darko, U.S. Appl. No. 14/011,042 entitled "Mechanical Locking System for Floor Panels," filed in the U.S. Patent and Trademark Office on Aug. 27, 2013.

Pervan, Darko, et al., U.S. Appl. No. 14/011,121 entitled "Mechanical Locking System for Floor Panels with Vertical Snap Folding," filed in the U.S. Patent and Trademark Office on Aug. 27, 2013.

Pervan, Darko, U.S. Appl. No. 14/042,887 entitled "Mechanical Locking of Floor Panels with a Glued Tongue," filed in the U.S. Patent and Trademark Office on Oct. 1, 2013.

Pervan, Darko, et al., U.S. Appl. No. 14/046,235 entitled "Mechanical Locking of Floor Panels with a Flexible Tongue," filed in the U.S. Patent and Trademark Office on Oct. 4, 2013.

Pervan, Darko, et al., U.S. Appl. No. 14/095,052, entitled "Mechanical Locking of Floor Panels," filed in the U.S. Patent and Trademark Office on Dec. 3, 2013.

Pervan, Darko, U.S. Appl. No. 14/080,105 entitled "Mechanical Locking of Floor Panels with Vertical Folding," filed in the U.S. Patent and Trademark Office on Nov. 14, 2013.

Nygren, Per, et al., U.S. Appl. No. 61/774,749, entitled "Building Panels Provided with a Mechanical Locking System," filed in the U.S. Patent and Trademark Office on Mar. 8, 2013.

Pervan, Darko, et al., U.S. Appl. No. 14/138,330 entitled "Mechanical Locking System for Floor Panels," filed in the U.S. Patent and Trademark Office on Dec. 23, 2013.

Pervan, Darko, U.S. Appl. No. 14/138,385 entitled "Mechanical Locking System for Panels and Method of Installing Same," filed in the U.S. Patent and Trademark Office on Dec. 23, 2013.

Pervan, Darko, et al., U.S. Appl. No. 14/152,402 entitled "Mechanical Locking System for Floor Panels," filed in the U.S. Patent and Trademark Office on Jan. 10, 2014.

* cited by examiner

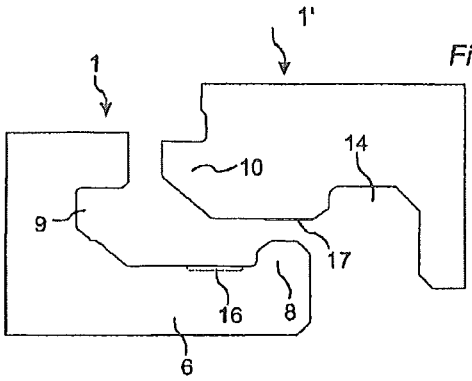
Fig. 1a
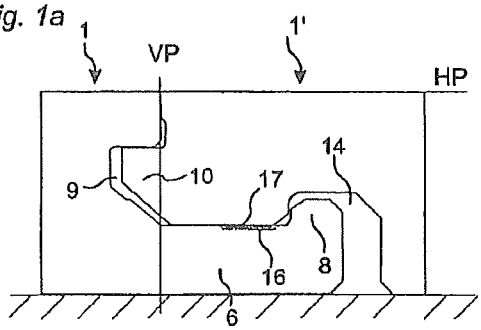
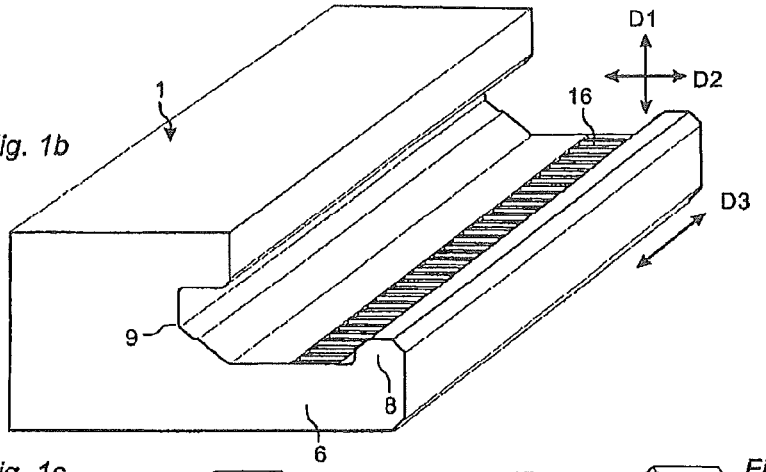
Fig. 1b
Fig. 1c
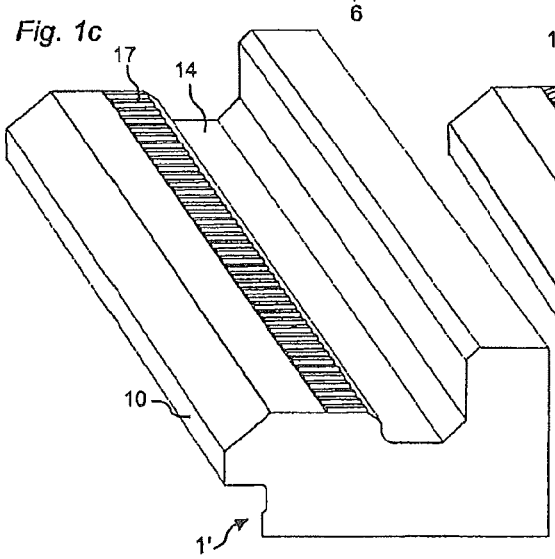
Fig. 1d
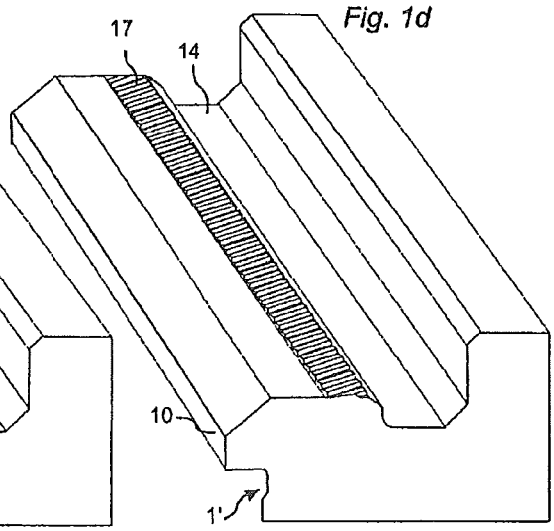

5a
R1
4a
R2
4b
Fl 1
Fl 2
Fl 3
5b
A 4b 4a
10
17
14
9
8
6 16

5b 5a
7
10
9
6

5a
R1
4a
R2
4b
Fl 1
Fl 2
Fl 3
5b
A 4b 4a
10
17
14
9
6 16 8

5b 5a
7
10
9
6

5a
R1
4a
R2
4b
Fl 1
Fl 2
Fl 3
5b 4b 4a
10
17
14
9
6 16

5b 5a
7
10
6

MECHANICAL LOCKING SYSTEM FOR FLOOR PANELS

CROSS REFERENCE TO RELATED APPLICATIONS

The present application is a continuation of U.S. application Ser. No. 11/822,684, filed on Jul. 9, 2007, which is a continuation of U.S. application Ser. No. 10/908,658, filed on May 20, 2005. The entire contents of each of U.S. application Ser. No. 11/822,984 and U.S. application Ser. No. 10/908,658 are hereby incorporated herein by reference.

TECHNICAL FIELD

The invention generally relates to the field of mechanical locking systems for floor panels and building panels. The invention comprises floorboards, locking systems, installation methods and production methods.

FIELD OF APPLICATION

The present invention is particularly suitable for use in floating floors, which are formed of floor panels which are joined mechanically with a locking system integrated with the floor panel, i.e. mounted at the factory, and are made up of one or more upper layers of veneer, decorative laminate or decorative plastic material, an intermediate core of wood-fiber-based material or plastic material and preferably a lower balancing layer on the rear side of the core. The following description of prior-art technique, problems of known systems and objects and features of the invention will therefore, as a non-restrictive example, be aimed above all at this field of application and in particular at laminate flooring formed as rectangular floor panels with long and shorts edges intended to be mechanically joined to each other on both long and short edges. The long and short edges are mainly used to simplify the description. The panels could be square.

It should be emphasized that the invention can be used in any floor panel and it could be combined with all types of known locking systems, where the floor panels are intended to be joined using a mechanical locking system connecting the panels in the horizontal and vertical directions on at least two adjacent sides. The invention can thus also be applicable to, for instance, solid wooden floors, parquet floors with a core of wood or wood-fiber-based material and a surface of wood or wood veneer and the like, floors with a printed and preferably also varnished surface, floors with a surface layer of plastic or cork, linoleum, rubber. Even floors with hard surfaces such as stone, tile and similar material are included, and floorings with soft wear layers, for instance, needle felt glued to a board. The invention can also be used for joining building panels which preferably contain a board material for instance wall panels, ceilings, furniture components and similar.

BACKGROUND

Laminate flooring usually consists of a core of a 6-12 mm fiber board, a 0.2-0.8 mm thick upper decorative surface layer of laminate and a 0.1-0.6 mm thick lower balancing layer of laminate, plastic, paper or like material. A laminate surface may consist of melamine impregnated paper. The most common core material is fiberboard with high density and good stability usually called HDF—High Density Fiberboard. Sometimes also MDF—Medium Density Fiberboard—is used as the core.

Traditional laminate floor panels of this type have been joined by means of glued tongue-and-groove joints.

In addition to such traditional floors, floor panels have been developed which do not require the use of glue and instead are joined mechanically by means of so-called mechanical locking systems. These systems comprise locking means, which lock the panels horizontally and vertically. The mechanical locking systems are usually formed by machining the core of the panel. Alternatively, parts of the locking system can be formed of a separate material, for instance aluminum or HDF, which is integrated with the floor panel, i.e., joined with the floor panel in connection with the manufacture thereof.

The main advantages of floating floors with mechanical locking systems are that they are easy to install. They can also easily be taken up again and used once more at a different location.

Definition of Some Terms

In the following text, the visible surface of the installed floor panel is called "front side", while the opposite side of the floor panel, facing the sub floor, is called "rear side". The edge between the front and rear side is called "joint edge". By "horizontal plane" is meant a plane, which extends parallel to the outer part of the surface layer. Immediately juxtaposed upper parts of two adjacent joint edges of two joined floor panels together define a "vertical plane" perpendicular to the horizontal plane. By "vertical locking" is meant locking parallel to the vertical plane in D1 direction. By "horizontal locking" is meant locking parallel to the horizontal plane in D2 direction. By "first horizontal locking" is meant a horizontal locking perpendicular to the joint edges in D2 direction. By "second horizontal locking is meant a horizontal locking in the horizontal direction along the joint which prevents two panels to slide parallel to each other when they are laying in the same plane and locked both vertically and in the first horizontal direction.

By "locking systems" are meant co acting connecting elements which connect the floor panels vertically and/or horizontally in the first horizontal direction D2. By "mechanical locking system" is meant that joining can take place without glue. Mechanical locking systems can in many cases also be joined by gluing. By "integrated with" means formed in one piece with the panel or factory connected to the panel.

Related Art and Problems Thereof

For mechanical joining of long edges as well as short edges in the vertical and in the first horizontal direction (direction D1, D2) several methods could be used. One of the most used methods is the angle-snap method. The long edges are installed by angling. The panel is than displaced in locked position along the long side. The short edges are locked by horizontal snapping. The vertical connection is generally a tongue and a groove. During the horizontal displacement, a strip with a locking element is bent and when the edges are in contact, the strip springs back and a locking element enters a locking groove and locks the panels horizontally. Such a snap connection is complicated since a hammer and a tapping block may need to be used to overcome the friction between the long edges and to bend the strip during the snapping action. The friction on the long side could be reduced and the panels could be displaced without tools. The snapping resistance is however considerable especially in locking systems made in one piece with the core. Wood based materials are generally difficult to bend. Cracks in the panel may occur during snapping. It would be an advantage if the panels could be installed by angling of long edges but without a snap action to lock the short edges. Such a locking could be accomplished with a locking system that locks the long edges in such a way that also displacement along the joint is counteracted.

It is known from Wilson U.S. Pat. No. 2,430,200 that several projections and recesses could be used to prevent displacement along the joint. Such projections and recesses are difficult to produce, the panels can only be locked in well defined positions against adjacent long edges and they can not be displaced against each other in angled position against each other when top edges are in contact. Terbrack U.S. Pat. No. 4,426,820 describes a locking system with a tight fit in a panel made of plastic material. The tight fit prevents displacement along the joint. A system with tight fit does not give a safe and reliable locking over time especially if the locking system is made of wood fiber based material, which swells and shrink when the humidity varies over time.

OBJECTS AND SUMMARY

A first overall objective of the present invention is to provide a locking system for primarily rectangular floor panels with long and short edges installed in parallel rows, which allows that the short edges could be locked to each other horizontally by the locking system on the long edges. The costs and functions should be favorable compared to known technology. A part of the overall objective is to improve the function and costs of those parts of the locking system that locks in the horizontal direction along the joint when panels are installed on a sub floor.

More specifically the object is to provide a second horizontal locking system on the long edges, hereafter referred to as "slide lock" where one or several of the following advantages are obtained.

The slide lock on the long edges should be activated when a panel is brought in contact with an already installed panel and then angled down to the sub floor.

The slide lock function should be reliable over time and the panels should be possible to lock and unlock in any position when two adjacent long edges are brought into contact with each other.

The slide lock should be strong and prevent that short edges of two locked panels will separate when humidity is changing or when people walk on a floor.

The slide lock should be possible to lock with high precision and without the use of tools.

The locking system and the slide lock should be designed in such a way that the material and production costs could be low.

A second objective is to provide an installation method for installation of floorboards with a slide lock.

A third objective is to provide a production method for a slide lock system.

The above objects of the invention are achieved wholly or partly by locking systems, floor panels, and installation and production methods according to the independent claim. Embodiments of the invention are evident from the dependent claims and from the description and drawings.

According to a first aspect of the invention, a flooring system is provided comprising a plurality of rectangular floor panels to be installed on a sub floor. The floor panels have long and short edges, which are connectable to each other along one pair of adjacent edges of adjacent panels. The connectable adjacent edges have a mechanical locking system comprising a tongue formed in one piece with the panel and a groove for mechanically locking together said adjacent edges at right angles to the horizontal plane of the panels, thereby forming a vertical mechanical connection between the panels. One pair of adjacent edges has a locking element at one first edge and a locking groove at an opposite second edge thereby forming a first horizontal mechanical connection locking the panels to each other in a direction parallel to the horizontal plane and at right angles to the joint edges. Each panel is at said adjacent edges provided with a second horizontal mechanical connection locking the panels to each other along the joint edges, in a direction parallel to the horizontal plane and parallel to the joint edges, when the panels are laying flat on the sub floor. The second horizontal mechanical connection comprises a plurality of small local protrusions in said mechanical locking system which prevents displacement along the joint edges when the panels are laying flat on the sub floor and are locked with the vertical and the first horizontal connections.

Although it is an advantage to integrate the slide locking system with the panel, the invention does not exclude an embodiment in which parts of the locking system are delivered as separate components to be connected to the panel by the installer prior to installation. Such separate components could be applied in the locking system in order to prevent displacement along the joint when two panels are locked by preferably angling. Displacement could also be prevented and additional strength could be accomplished with a locking system which is pre glued.

It is an advantage if the short edges have a vertical locking preferably with a tongue and a groove. The short edges could however be made without vertical locking especially if the panels are narrow. In such a case long edges will also lock the short edges even in the vertical direction.

The invention is especially suited for use in floor panels, which are difficult to snap for example because they have a core, which is not flexible, or strong enough to form a strong snap locking system. The invention is also suitable for wide floor panels, for example with a width larger than 20 cm, where the high snapping resistance is a major disadvantage during installation, in panels where parts of the locking system on the long edge is made of a material with high friction, such as wood and in locking systems which are produced with tight fit or without play or even with pretension. Especially panels with such pretension where the locking strip is bent in locked position and presses the panels together are very difficult to displace and snap. A locking system that avoids snapping will decrease the installation time of such panels considerably. However, a tight fit and pretension in the locked position could improve the strength of the slide lock. An alternative to small protrusions, in some applications, is to use a high friction core material together with a tight fit between as many adjacent surfaces in the locking system as possible. Even a wood based material might be used if normal shrinking and swelling is reduced.

The invention is also suited to lock parallel rows to each other such that the rows maintain their position after installation. This could be an advantage in floors which are installed in advanced patterns such as tiles or stone reproductions where grout lines or other decorative effect must be aligned accurately or in any other installation where it is an advantage if the floor panels can not slide after installation.

According to a second aspect of the invention a production method is provided to make a mechanical locking system between two edges of a first and second panel containing a wood fiber based core. According to the invention the locking system is formed at least partly in the core and comprises protrusions formed in the wood based core. The protrusions are at least partly formed by embossing.

According to a third aspect of the invention an installation method to install a floor is provided, comprising a plurality of rectangular floor panels laying in parallel rows on a sub floor with long and short edges which are connectable to each other along one pair of adjacent long edges and one pair of adjacent short edges. The panels have a mechanical locking system comprising a tongue formed in one piece with the panels and groove for mechanically locking together said adjacent long and short edges at right angles to the horizontal plane of the panels, thereby forming a vertical mechanical connection between the panels. The panels have also a locking element at one first long edge and a locking groove at an opposite second long edge which form a first horizontal mechanical connection locking the long edges of the panels to each other in a direction parallel to the horizontal plane and at right angles to the joint edges. Each panel is at said adjacent long edges provided with a second horizontal mechanical connection locking the panels to each other along the joined long edges when the panels are laying flat on the sub floor. The second horizontal mechanical connection comprises small local protrusions in said mechanical locking system on the long edges which prevents displacement along the joint when the panels are laying flat on the sub floor and are locked with the vertical and the first horizontal connections. The method comprises five steps:

a) As a first step a first panel is installed on a sub floor in a first row.
b) As a second step a second panel in a second row is brought in contact with its long edge against the long edge of the first panel and held at an angle against the sub floor.
c) As a third step a new panel in a second row is brought at an angle with its long edge in contact with the long edge of the first panel and its short edge in contact with the short edge of the second panel.
d) As a fourth step the new panel is displaced against the second panel in the angled position and the tongue is inserted into the groove until the top edges at the short edges are in contact with each other.
e) As a final fifth step the second and new panels are angled down to the sub floor. This angling locks the long edges of the second and new panels to the first panel in a vertical direction and in a first horizontal direction perpendicular to the joined long edges and in a second horizontal direction along the long edges. The locking in the second horizontal direction prevents separations between the short edges of the second and the new panel.

BRIEF DESCRIPTION OF THE DRAWINGS

FIGS. 1*a-d* illustrate two embodiments of the invention.

DESCRIPTION OF EMBODIMENTS OF THE INVENTION

Figure 2A:
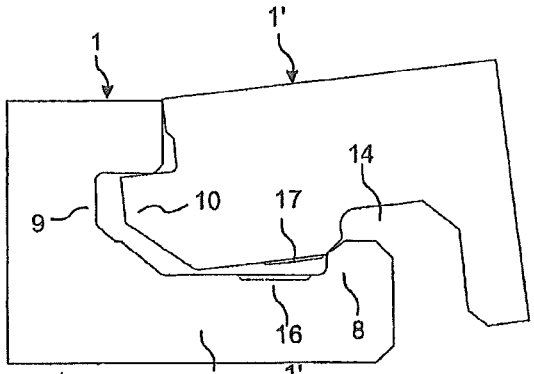
FIGS. 2*a-d* illustrate locking of the slide lock with angling.

To facilitate understanding, several locking systems in the figures are shown schematically. It should be emphasized that improved or different functions can be achieved using combinations of the preferred embodiments. The inventor has tested all known and especially all commercially used locking systems on the market in all type of floor panels, especially laminate and wood floorings and the conclusion is that at least all these known locking systems which have one or more locking elements cooperating with locking grooves could be adjusted to a system with a slide lock which prevents displacement along the adjacent edges. The locking systems described by the drawings could all be locked with angling. The principles of the invention could however also be used in snap systems or in systems which are locked with a vertical folding. The slide lock prevents sliding along the joint after snapping or folding.

The invention does not exclude floor panels with a slide lock on for example a long and/or a short side and floor panels with a angling, snapping or vertical folding lock on short side which locks horizontally and where the slide lock on the long side for example gives additional strength to the short side locking.

The most preferable embodiments are however based on floorboards with a surface layer of laminate or wood, a core of HDF or wood and a locking system on the long edge with a strip extending beyond the upper edge which allows locking by angling combined with a tongue and groove joint on the short edges. The described embodiments are therefore non-restrictive examples based on such floor panels. All embodiments could be used separately or in combinations. Angles, dimensions, rounded parts, spaces between surfaces etc are only examples and could be adjusted within the basic principles of the invention.

A first preferred embodiment of a floor panel 1, 1' provided with a slide lock system according to the invention is now described with reference to FIGS. 1*a*-1*d*.

FIG. 1*a* illustrates schematically a cross-section of a joint preferably between a long side joint edge of a panel 1 and an opposite long side joint edge of a second panel 1'.

The front sides of the panels are essentially positioned in a common horizontal plane HP, and the upper parts of the joint edges abut against each other in a vertical plane VP. The mechanical locking system provides locking of the panels relative to each other in the vertical direction D1 as well as the horizontal direction D2.

To provide joining of the two joint edges in the D1 and D2 directions, the edges of the floor panel 1 have in a manner known per se a locking strip 6 with a locking element 8, and a groove 9 made in one piece with the panel in one joint edge and a tongue 10 made in one piece with the panel at an opposite edge of a similar panel 1'. The tongue 10 and the groove 9 provide the vertical locking D1.

The mechanical locking system according to an embodiment of the invention comprises a second horizontal locking 16, 17 formed as small local protrusions on the upper part of the strip 6 and on the lower part of the panel 1' in the edge portion between the tongue 10 and the locking groove 14. When the panels 1, 1' are locked together in a common plane and are laying flat on the sub floor as shown in FIG. 1*a*, the small local protrusions 16, 17 are pressed to each other such that they grip against each other and prevent sliding and small displacement along the joint in a horizontal direction D3. This embodiment shows the first principle of the invention where the local protrusions are formed in the panel material. As a non restrictive example it could be mentioned that the upper 17 and lower 16 protrusions could be very small, for example only 0.1-0.2 mm high and the horizontal distance between the protrusions along the joint could be for example 0.1-0.5 mm. The distance between the upper protrusions could be slightly different than the distance between the lower protrusions. In locked position some protrusions will grip behind each other and some will press against each other but over the length of the floor boards there will be enough resistance to prevent sliding. The friction and the locking will be sufficient even in small cut off pieces at the end of the installed rows.

Figure 5A:
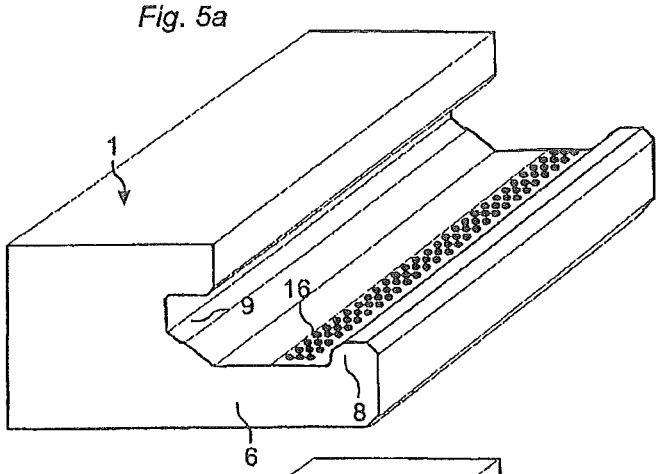
FIGS. 5*a-e* illustrate another embodiment of the invention.

FIG. 1*b* shows an embodiment where small local protrusions 16 are formed on the upper part of the strip 8 adjacent to the locking element 8. The protrusions have a length direction which is essentially perpendicular to the edge of the floorboard. D1 show the locking in the vertical direction, D2 in the first horizontal direction and D3 in the second horizontal direction along the joint edge. FIG. 1*c* shows that similar protrusions could be formed on the lower side of the adjacent panel 1' in a portion which is located between the locking groove 14 and the tongue 10. The protrusions on one edge could be different to the protrusions on the other adjacent edge. This is shown in FIG. 1*d* where the length direction of the protrusions has a different angle than the protrusions on the strip 6 in FIG. 1*b*. When two such panels are connected the protrusions will always overlap each other and prevent displacement in all locked positions. A strong locking could be accomplished with very small protrusions. The protrusions in this embodiment which is based on the principle that the protrusions 16, 17 are formed in one piece with the panel material could for example have a length of 2-5 mm, a height of 0.1-0.5 mm and a width of 0.1-0.5 mm. Other shapes are of course possible for example round or square shaped protrusions arranged as shown in FIG. 5*a*.

Figure 2B:
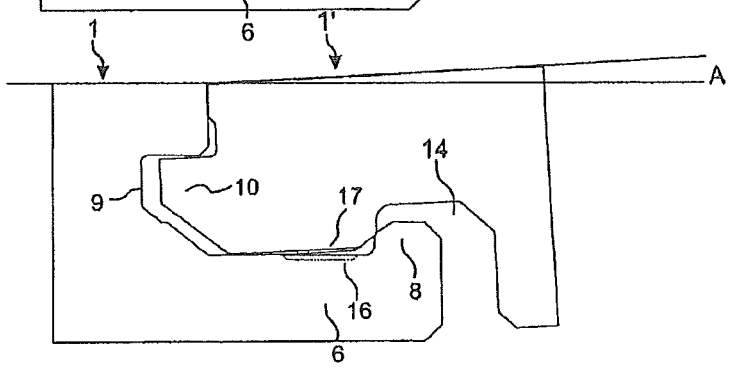
Figure 2C:
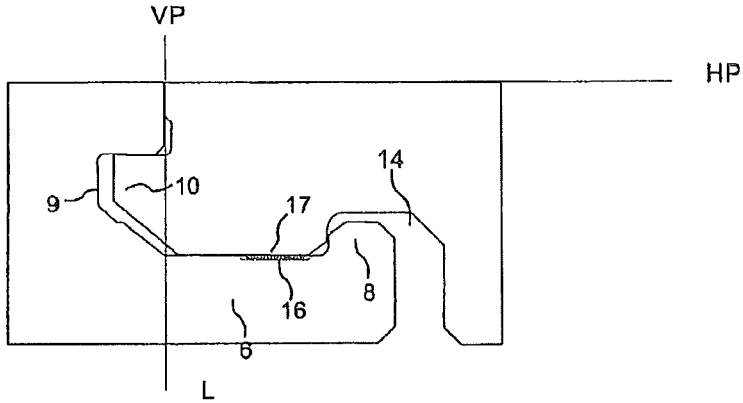

FIGS. 2*a*-2*c* show locking of a slide lock system. In this preferred embodiment the panels 1, 1' are possible to displace even when the locking element 8 is partly in the locking groove. This is an advantage when connecting the short edges with a tongue and a groove FIG. 2*b* show that the local protrusions are in contact with each other when the adjacent panels 1, 1' are held at a small locking angle A for example of about 3 degrees against the sub floor. Lower locking angles are possible but could cause problems when the panels are installed on an uneven sub floor. Most preferable locking angles are 3-10 degrees but of course locking systems with other locking angles smaller or larger could be designed. FIG. 2*c* shows the slide lock in locked position.

Figure 2D:
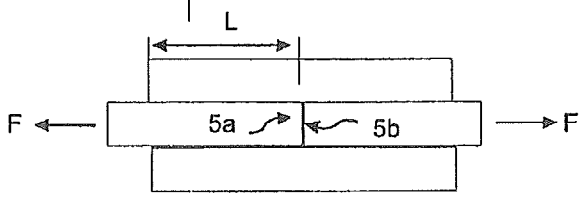

FIG. 2*d* show a testing method to test the sliding strength F of a slide lock. Test show that even small protrusions could prevent displacement of the short edges 5*a* and 5*b* of two panels. A slide lock could prevent displacement of the short edges when a pulling force F equal to 1000 N is applied to the panels with a slide lock length L of 200 mm on both long edges. This corresponds to a sliding strength of 5000 N per 1000 mm of slide lock length. This means that even small pieces with a length of 100 mm could be locked with a locking force of 500 N and this is in most applications sufficient. A slide lock could be designed with a sliding strength of more than 10,000 N per 1000 mm joint length. Even sliding strengths of 20,000 N or more could be reached and this is considerably more than the strength of traditional mechanical locking systems. Such systems are generally produced with a horizontal locking strength of 2000-5000 N per 1000 mm joint length. A preferable embodiment is locking systems where the slide strength of the slide lock in the second horizontal direction exceeds the locking strength of the mechanical locking system in the first horizontal direction. A high sliding strength is an important feature in a floating floor where small pieces often are installed as end pieces against the walls. In some applications a sliding strength of at least 50% of the horizontal locking strength is sufficient. In other applications, especially in public places 150% is required.

Figure 3:
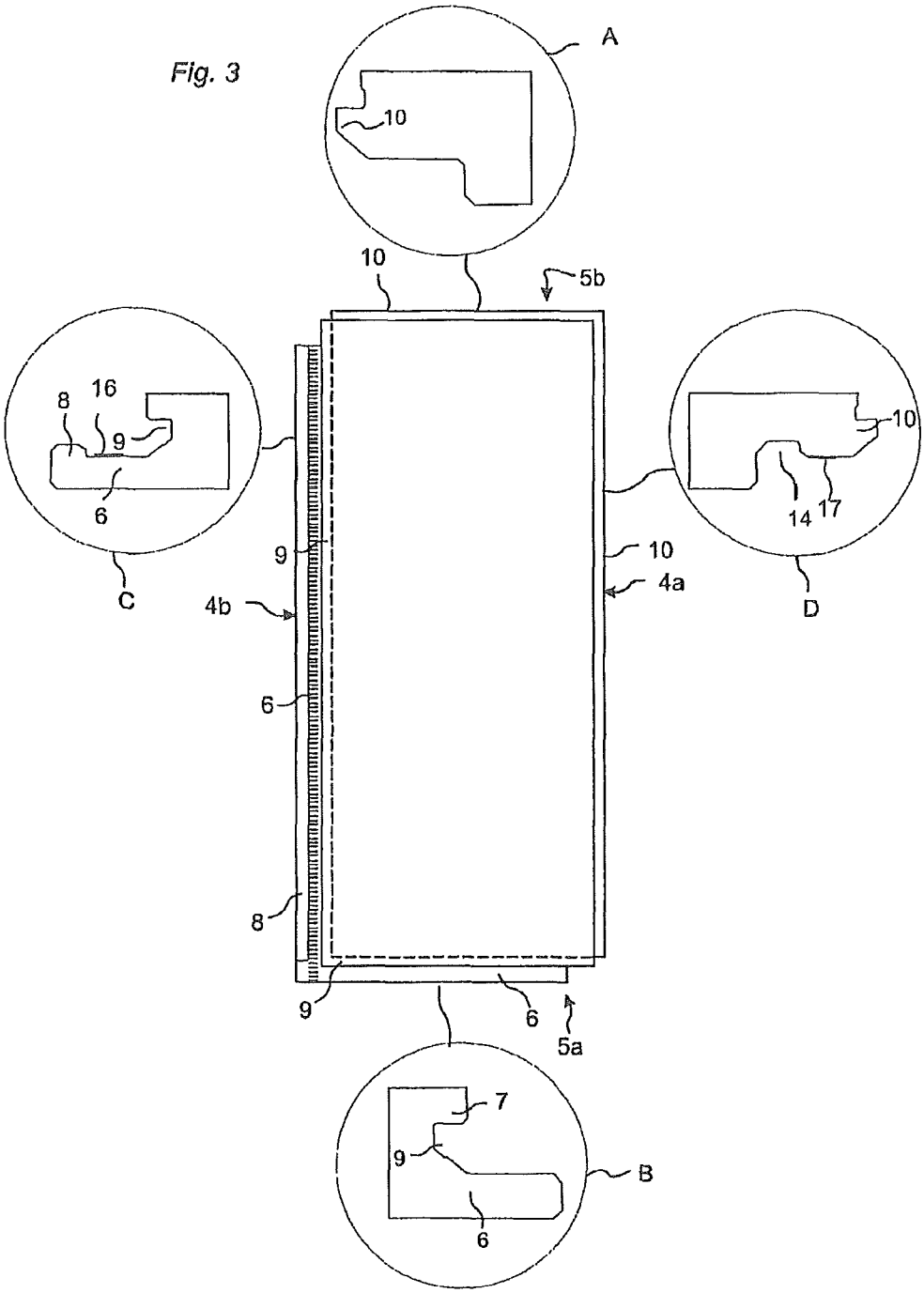
FIG. 3 illustrates a floorboard with a slide lock on long side.

FIG. 3 shows a preferred embodiment of a floor panel with long 4*a*, 4*b* and short 5*a*, 5*b* edges. The long edges have a slide lock (C,D) with upper 17 and lower 16 protrusions over substantially the whole length of the long edges. The short edges have only a vertical locking system (A,B) with a tongue 10 and a groove 9. The lower lip 6 is a strip and extends beyond the upper lip 7.

Figure 4A:
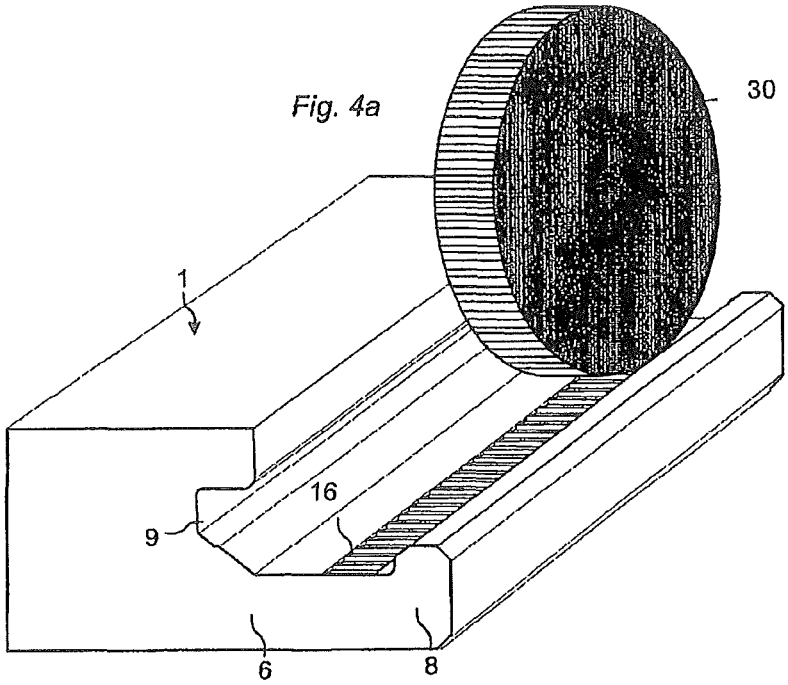
FIGS. 4*a-b* illustrates a production method to form a slide lock.

FIG. 4*a* shows a production method to form small local protrusions in a wood based material. The protrusions are formed by embossing. This could be done with a press or with any other appropriate method where a tool is pressed against the wood fibers. Another alternative is to brush or to scrape parts of the locking system to form small local protrusions. The most preferable method is a wheel 30, which is rolled against the wood fibers with a pressure such that small local protrusions 16 are formed by compression of wood fibers. Such an embossing could be made continuous in the same machining line where the other parts of the locking system are formed.

Figure 4B:
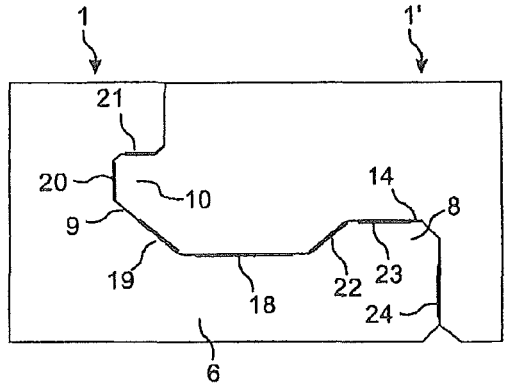

FIG. 4*b* shows that the local protrusions could be formed between the tongue 10 and the groove 9, at the upper part 21 of the tongue, at the tip 20 of the tongue and at the lower outer part 19 of the tongue. They could also be formed between the upper part 18 of the strip and the adjacent edge portion and/or between the locking element 8 and the locking groove 14 at the locking surfaces 22, at the upper part 23 of the locking element and at the outer distal part 24 of the locking element. The local protrusions could be formed on only one edge portion or preferably on both edge portions and all these locations could be used separately or in combinations.

Compression of wood fibers with a wheel could also be used to form parts of the locking system such as the locking grove 14 or the locking element 8 or any other parts. This production method makes it possible to compress fibers and to form parts with smooth surfaces, improved production tolerances and increased density.

Figure 5B:
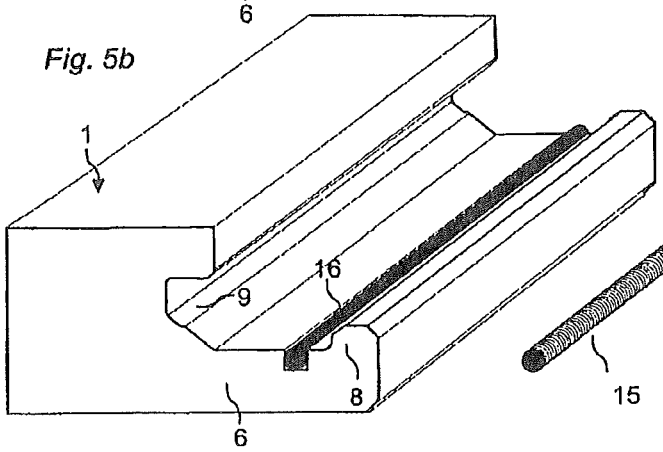
Figure 5C:
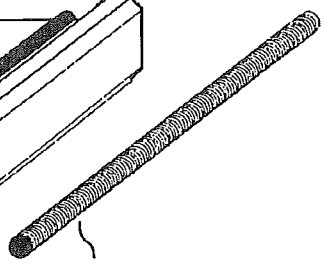
Figure 5D:
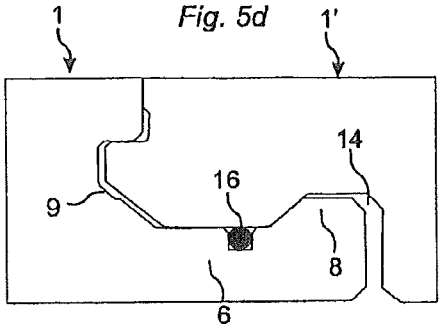
Figure 5E:
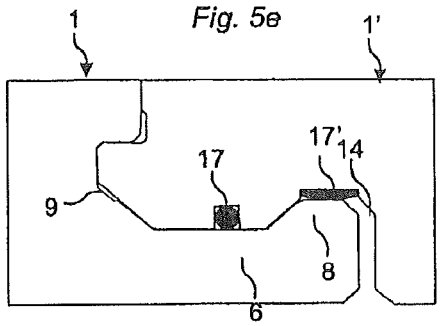

FIG. 5*a* shows another embodiment according to a second principle. The protrusions 16 could be applied as individual parts of a separate material such as rubber, polymer materials or hard sharp particles or grains which are applied into the locking system with a binder. Suitable materials are grains similar to those generally used in sandpaper, metal grains, especially aluminum particles. This embodiment could be combined with the first principle where protrusions formed in one piece with the panel material cooperates with a separate material which is applied into the locking system and which also could have cooperating protrusions. FIG. 5*b* shows an embodiment where a rubber strip is applied into the locking system. Separate high friction material could create a strong slide lock even without any protrusions but protrusions in the panel and/or in the separate material gives a stronger and safer slide lock. FIG. 5*c* shows that an embossed aluminum extrusion or wire 15 could be applied into the locking system. FIGS. 5*d* and 5*e* shows preferable location of the separate friction material 16, 17, 17'.

The following basic principles to make a slide lock have now been described:

Local protrusions are formed in one piece with the panel material preferably on both adjacent edges and they cooperate with each other in locked position.

A separate material softer than the panel material is applied in the locking system and this material could preferably cooperate with the protrusions which are formed in one piece with the panel.

A separate material harder than the material of the panel is applied in the locking system. Parts of this harder material, which preferably has sharp protrusions or grains, are in locked position pressed into the panel material.

Separate soft and flexible friction material is applied into the locking system with or without protrusions.

All of these principles could be used separately or in combinations and several principles could be used in the same locking system. For example a soft material could be applied on both edges and local protrusions could also be formed on both edges and both local protrusions could cooperate with both soft materials.

Figures 6A, 6B, 6C, 6D, 6E, 6F, 6G, 6H, 6I:
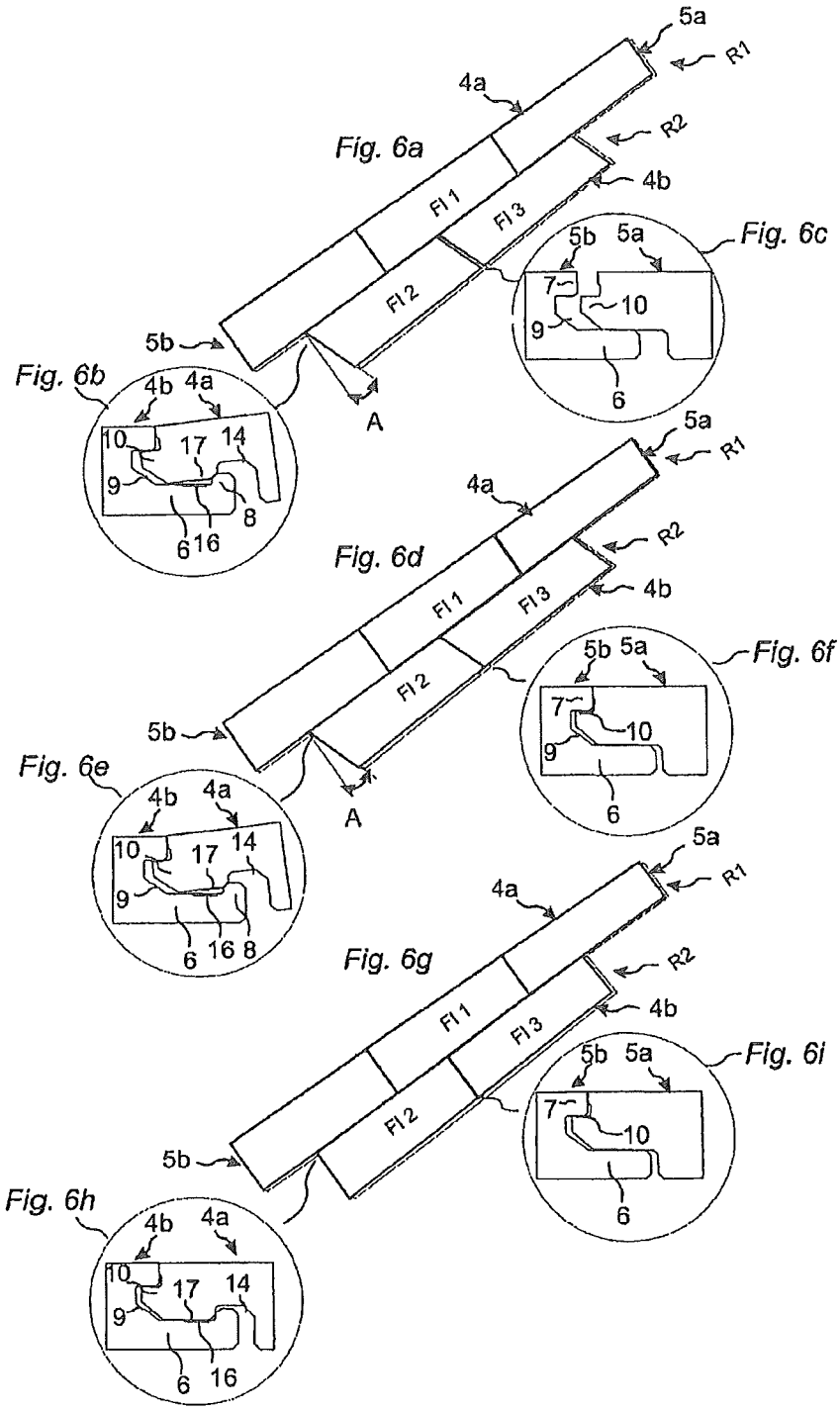
FIGS. 6*a-i* illustrate an installation method according to an embodiment of the invention.

FIGS. 6*a*-6*i* shows a method to install a floor of rectangular floor panels in parallel rows with a slide lock. The floor panels have long 4*a*,4*b* and short 5*a*,5*b* edges. The panels have a mechanical locking system comprising a tongue 10 formed in one piece with the panels and groove 9 for mechanically locking together adjacent long and short edges vertically in D1 direction. The panels have also a locking element 8 at one first long edge and a locking groove 14 at an opposite second long edge which form a first horizontal mechanical connection locking the long edges of the panels to each other in a D2 direction parallel to the horizontal plane and at right angles to the joint edges. Each panel is at the adjacent long edges provided with a second horizontal mechanical connection locking the panels to each other along the joined long edges in the D3 direction when the panels are laying flat on the sub floor. The second horizontal mechanical connection comprises small local protrusions 16, 17 in the mechanical locking system on the long edges which prevents displacement along the joint when the panels are laying flat on the sub floor and are locked in D1 and D2 directions. The method comprises five steps:

a) As a first step a first panel Fl 1 is installed on a sub floor in a first row R1.

b) As a second step a second panel Fl 2 in a second row R2 is brought in contact with its long edge 4*a* against the long edge 4*b* of the first panel Fl 1 and held at an angle A against the sub floor.

c) As a third step a new panel Fl 3 in a second row R2 is brought at an angle A with its long edge 4*a* in contact with the long edge 4*b* of the first panel Fl 1 and its short edge 5*a* in contact with the short edge 5*b* of the second panel FL 2. In this preferred embodiment the tongue 10 is angled on the strip 6 which is an extension of the lower lip of the grove 9. These 3 steps are shown in FIGS. 6*a*, 6*b* and 6*c*.

d) As a fourth step the new panel Fl 3 is displaced against the second panel Fl 2 in the angled position and the tongue 10 is inserted into the groove 9 until the top edges at the short edges 5*a*, 5*b* are in contact with each other. This is shown in FIGS. 6*d*-6*f*.

e) As a final fifth step the second panel Fl 2 and new panel Fl 3 are angled down to the sub floor. This angling locks the long edges 4*a*, 4*b* of the second Fl 2 and new Fl 3 panels to the first panel Fl 1 in a vertical direction D1 and in a first horizontal direction D2 perpendicular to the joined long edges and in a second horizontal direction D3 along the long edges. The locking in the second horizontal direction D3 prevents separations between the short edges 5*a*, 5*b* of the second Fl 2 and the new panel Fl 3. This is shown in FIGS. 6*g*-6*i*.

It is not necessary that the second and the new panels are held in the same angle since some twisting of the panels may occur or may even be applied to the panels.

The installation method and the locking system according to the embodiments of the invention make it possible to install floor panels in a simple way without tools and without any snap action on the short sides. The locking system could be designed in such a way that the upper part of the locking element keeps the floorboards in an angled position until they are pressed down to the sub floor.

If the short edges do not have a tongue, installation could be made by just angling the floor boards to the sub floor. Even the traditional installation with angling the new panel Fl 3 to the sub floor and thereafter displacing the new panel towards the second panel Fl 2 could be used. The disadvantage is that a hammer and a tapping block should be used to overcome the resistance of the slide lock. This could be done without damaging the slide lock or substantially decreasing the sliding strength since the panels will be pushed upwards into a small angle by the small local protrusions.

Figure 7A:
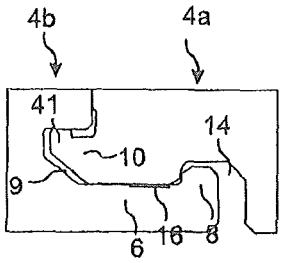
FIGS. 7*a-i* illustrate floor panels, which could be installed in a herringbone pattern and in parallel rows according to an embodiment of the invention.
Figure 7E:
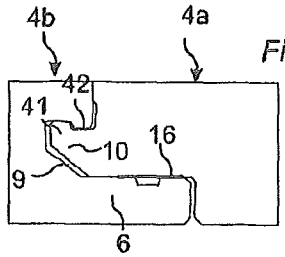
Figure 7B:
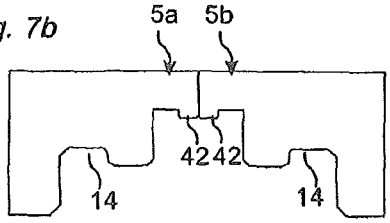
Figure 7F:
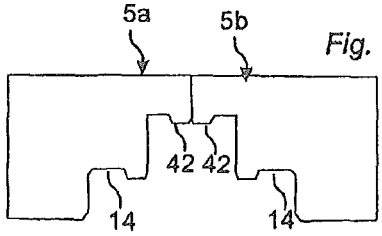
Figure 7C:
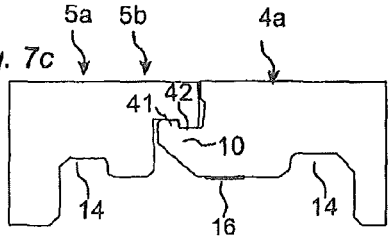
Figure 7G:
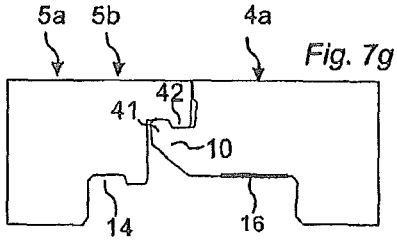
Figure 7D:
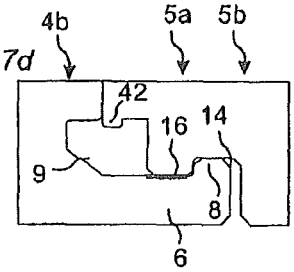
Figure 7H:
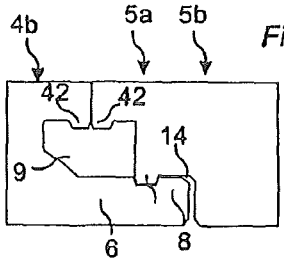

FIGS. 7*a*-7*i* show preferred embodiments of floorboards which are only A panels and which could be installed in a herringbone pattern and in parallel rows. FIGS. 7*a*-7*d* show a locking system where the horizontal locking in D2 direction is obtained by a strip 6, a locking element 8 and a locking groove 14. In FIGS. 7*e*-7*h* the horizontal locking D2 is obtained by a tongue lock where a locking element 41 on the upper part of the tongue locks against another locking element 42 in the upper part of the groove 9. The figures show long edges 4*a*, 4*b* short edges 5*a*, 5*b* and long edges 4*a* or 4*b* locked against the short edges 5*a*, 5*b*. The advantage of such a locking system is that a herringbone pattern could be created with only one type of A panels. The locking elements 41, 42, 8 and the locking groove 14 locks both short edges 5*a*, 5*b* of one panel to both long edges 4*a*,4*b* of a similar panel. The disadvantage is that such panels can not be installed in parallel rows since the short edges can not be locked horizontally. This is shown in FIGS. 7*c* and 7*g*. This problem could be solved however with a slide loc 16 on the long edges. The invention comprises one type of panels which could be installed in parallel rows and in a herringbone pattern and which at the long edges have a slide lock according to the described embodiments above.

Figure 7I:
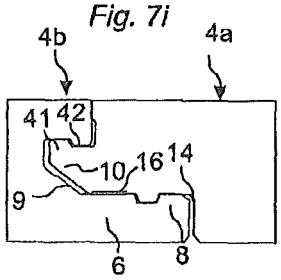

FIG. 7*i* shows a strong locking system with a slide lock and with a locking element 8 and a locking groove 14 and with locking elements 41,42 in the upper part of the tongue 10 and the groove 9. The locking element 42 in the locking groove could be formed with a scraping tool.

Figure 8A:
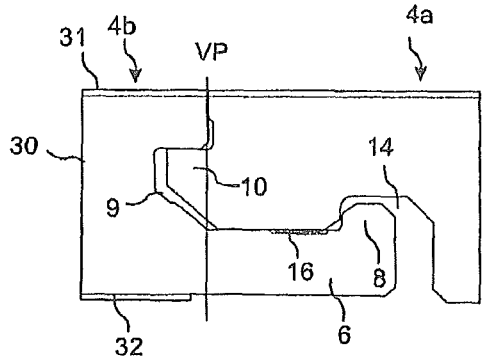
FIGS. 8*a*-8*d* illustrate embodiments according to the invention.

FIG. 8*a* shows a floor panel with a surface layer 31, a core 30 and a balancing layer 32. Part of the balancing layer has been removed under the strip 6 to prevent backwards bending of the strip in dry or humid environment. Such bending could reduce the strength of the slide lock especially in laminate floors installed in dry environment.

Figure 8B:
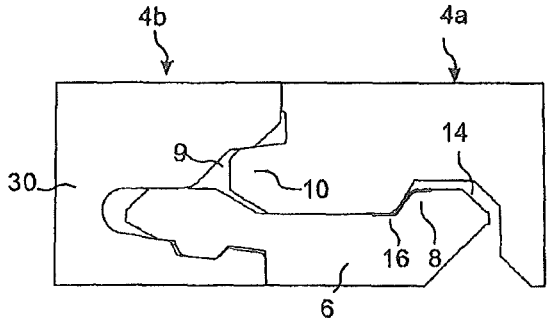

FIG. 8*b* shows an embodiment with a separate wood based strip 6 which has a flexible friction material 16.

Figure 8C:
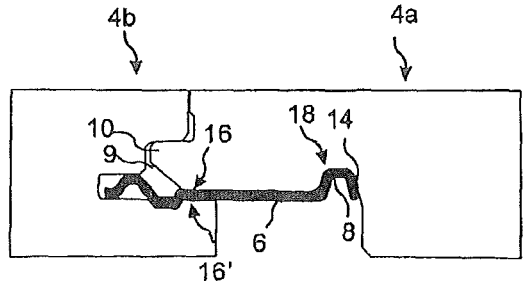
Figure 8D:
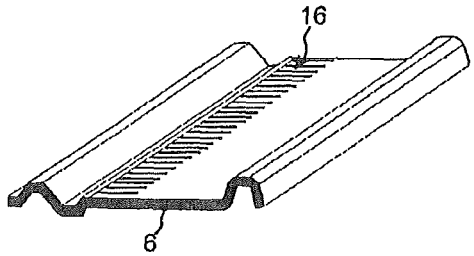

FIGS. 8*c* and 8*d* shows a separate strip of aluminum. Small local protrusions 16, 16' are formed on the upper and lower parts of the strip 6. These protrusions prevent sliding between the strip and the two adjacent edges 4*a* and 4*b*.

It will be apparent to those skilled in the art that various modifications and variations of the present invention can be made without departing from the spirit and scope of the invention. Thus, it is intended that the present invention include the modifications and variations of this invention provided they come within the scope of the appended claims and their equivalents.

The invention claimed is:

1. A method to install a floor comprising a plurality of rectangular floor panels laying in parallel rows on a sub floor with long and short edges which are connectable to each other along one pair of adjacent long edges and one pair of adjacent short edges, said panels having a mechanical locking system comprising a tongue and a groove for mechanically locking together said adjacent long and short edges at right angles to the horizontal plane of the panels, thereby forming a vertical mechanical connection between the panels, and a locking element at one first long edge and a locking groove at an opposite second long edge thereby forming a first horizontal mechanical connection locking the long edges of the panels to each other in a direction parallel to the horizontal plane and at right angles to the joint edges, each panel at said adjacent long edges being provided with a second horizontal mechanical connection locking the panels to each other along the joined long edges in a direction parallel to the horizontal plane and parallel to the joint edges when the panels are laying flat on the sub floor, said second horizontal mechanical connection comprises local protrusions arranged in a pattern that repeats in a direction along the joint edges in said mechanical locking system on the long edges which reduces displacement of the panels in a direction along the joint when the panels are laying flat on the sub floor and are locked with the vertical and the first horizontal connections, the method comprising:

installing a first panel on a sub floor in a first row, bringing a second panel in a second row into contact with its long edge against the long edge of the first panel and held at an angle against the sub floor, bringing a new panel in a second row at an angle with its long edge in contact with the long edge of the first panel and its short edge in contact with the short edge of the second panel, displacing the new panel against the second panel in the angled position thereby bringing the tongue into the groove until the top edges at the short edges are in contact with each other, angling the second and new panels down to the sub floor thereby locking the long edges of the second and new panels to the first panel in a vertical direction and in a first horizontal direction perpendicular to the joined long edges and in a second horizontal direction along the long edges whereby the locking in the second horizontal direction prevents separations between the short edges of the second and the new panel.

2. The method as claimed in claim 1, wherein the panels have a surface layer of laminate or wood.

3. The method as claimed in claim 1, wherein the groove has an upper lip and lower lip on its lower part which extends beyond the upper lip.

4. The method as claimed in claim 3, wherein the tongue is on the short edge of the new panel and the lower lip on the short edge of the second panel and that the tongue is angled on the lower lip when the new panel is brought into the contact with the second panel.

5. The method as claimed in claim 1, wherein the local protrusions in said mechanical locking system on the long edges prevents displacement along the joint when the panels are laying flat on the sub floor and are locked with the vertical and the first horizontal connections.

6. The method as claimed in claim 1, wherein the first and second panels have long and short edges which are connectable to each other, said short edges lock together only at right angles to a horizontal plane of the panels.

7. A flooring system, comprising a plurality of rectangular floor panels adapted to be installed on a sub floor, said floor panels having long and short edges which are connectable to each other along one pair of adjacent edges of adjacent panels having a mechanical locking system comprising a tongue and a groove for mechanically locking together said adjacent edges at right angles to the horizontal plane of the panels, thereby forming a vertical mechanical connection between the panels, and a locking element at one first edge and a locking groove at an opposite second edge thereby forming a first horizontal mechanical connection locking the panels to each other in a direction parallel to the horizontal plane and at a right angle to joint edges of the adjacent panels, wherein:

each panel at said adjacent edges being provided with a second horizontal mechanical connection locking the panels to each other along the joint edges, in a direction parallel to the horizontal plane and parallel to the joint edges, when the panels are laying flat on the sub floor, said second horizontal mechanical connection comprises a plurality of local protrusions in said mechanical locking system which prevents the panels from displacing in a direction along the joint edges when the panels are laying flat on the sub floor and are locked with the vertical and the first horizontal connections, the protrusions being arranged in a pattern that repeats in a direction along the joint edges.

8. The flooring system as claimed in claim 7, wherein the locking groove is open towards the rear side.

9. The flooring system as claimed in claim 7, wherein the protrusions are formed on both the first and the second edge.

10. The flooring system as claimed in claim 7, wherein the first horizontal locking connection comprises a strip which is an extension of the lower part of the groove and the locking element is formed on the strip.

11. The flooring system as claimed in claim 7, wherein the mechanical locking system comprises a separate material, other than the material of the panel core, which is connected to the floorboard.

12. The flooring system as claimed in claim 11, wherein the local protrusions are formed in the separate material.

13. The flooring system as claimed in claim 7, wherein essentially the whole length of the edge comprises the local protrusions.

14. The flooring system as claimed in claim 7, wherein there is a space between the local protrusions and the adjacent edge of the adjacent panel when the adjacent panels are in an angled position relative each other.

15. The flooring system as claimed in claim 14, wherein the adjacent panels are displaceable along the joint edges when the upper part of joint edges are in contact and when said adjacent panels are in an angled position relative each other.

16. The flooring system as claimed in claim 7, wherein the mechanical locking system is configured to connect adjacent panels by inward angling to a locked position.

17. The flooring system as claimed in claim 16, wherein the second horizontal mechanical connection prevents displacement along both directions of the joint edges.

18. A flooring system, comprising a plurality of rectangular floor panels adapted to be installed on a sub floor, said floor panels having long and short edges which are connectable to each other along one pair of adjacent edges of adjacent panels having a mechanical locking system comprising a tongue and a groove for mechanically locking together said adjacent edges at right angles to the horizontal plane of the panels, thereby forming a vertical mechanical connection between the panels, and a locking element at one first edge and a locking groove at an opposite second edge thereby forming a first horizontal mechanical connection locking the panels to each other in a direction parallel to the horizontal plane and at a right angle to joint edges of the adjacent panels, wherein:

each panel at said adjacent edges being provided with a second horizontal mechanical connection locking the panels to each other along the joint edges, in a direction parallel to the horizontal plane and parallel to the joint edges, when the panels are laying flat on the sub floor, said second horizontal mechanical connection comprises a plurality of local protrusions in said mechanical locking system which prevents the panels from displacing in a direction along the joint edges when the panels are laying flat on the sub floor and are locked with the vertical and the first horizontal connections, wherein the local protrusions are formed in one piece with the panel.

19. The flooring system as claimed in claim 7, wherein each local protrusion comprises an individual part of a separate material, other than the material of the panel core, which individual parts are applied in the mechanical locking system and connected to the floorboard.

20. A flooring system, comprising a plurality of rectangular floor panels adapted to be installed on a sub floor, said floor panels having long and short edges which are connectable to each other along one pair of adjacent edges of adjacent panels having a mechanical locking system comprising a tongue and a groove for mechanically locking together said adjacent edges at right angles to the horizontal plane of the panels, thereby forming a vertical mechanical connection between the panels, and a locking element at one first edge and a locking groove at an opposite second edge thereby forming a first horizontal mechanical connection locking the panels to each other in a direction parallel to the horizontal plane and at a right angle to joint edges of the adjacent panels, wherein:

each panel at said adjacent edges being provided with a second horizontal mechanical connection locking the panels to each other along the joint edges, in a direction parallel to the horizontal plane and parallel to the joint edges, when the panels are laying flat on the sub floor, said second horizontal mechanical connection comprises a plurality of local protrusions in said mechanical locking system which prevents the panels from displacing in a direction along the joint edges when the panels are laying flat on the sub floor and are locked with the vertical and the first horizontal connections, wherein the mechanical locking system comprises a separate material, other than the material of the panel core, which is connected to the floorboard.

wherein local protrusions are formed in the panel such that they cooperate with the separate material when two floor panels are locked in the same plane.

21. A flooring system, comprising a plurality of rectangular floor panels adapted to be installed on a sub floor, said floor panels having long and short edges which are connectable to each other along one pair of adjacent edges of adjacent panels having a mechanical locking system comprising a tongue and a groove for mechanically locking together said adjacent edges at right angles to the horizontal plane of the panels, thereby forming a vertical mechanical connection between the panels, and a locking element at one first edge and a locking groove at an opposite second edge thereby forming a first horizontal mechanical connection locking the panels to each other in a direction parallel to the horizontal plane and at a right angle to joint edges of the adjacent panels, wherein:

each panel at said adjacent edges being provided with a second horizontal mechanical connection locking the panels to each other along the joint edges, in a direction parallel to the horizontal plane and parallel to the joint edges, when the panels are laying flat on the sub floor, said second horizontal mechanical connection comprises a plurality of local protrusions in said mechanical locking system which prevents the panels from displacing in a direction along the joint edges when the panels are laying flat on the sub floor and are locked with the vertical and the first horizontal connections, wherein the mechanical locking system comprises a separate material, other than the material of the panel core, which is connected to the floorboard, wherein the local protrusions are formed in the separate material and in the panel.

22. A flooring system, comprising a plurality of rectangular floor panels adapted to be installed on a sub floor, said floor panels having long and short edges which are connectable to each other along one pair of adjacent edges of adjacent panels having a mechanical locking system comprising a tongue and a groove for mechanically locking together said adjacent edges at right angles to the horizontal plane of the panels, thereby forming a vertical mechanical connection between the panels, and a locking element at one first edge and a locking groove at an opposite second edge thereby forming a first horizontal mechanical connection locking the panels to each other in a direction parallel to the horizontal plane and at a right angle to joint edges of the adjacent panels, wherein:

each panel at said adjacent edges being provided with a second horizontal mechanical connection locking the panels to each other along the joint edges, in a direction parallel to the horizontal plane and parallel to the joint edges, when the panels are laying flat on the sub floor, said second horizontal mechanical connection comprises a plurality of local protrusions in said mechanical locking system which prevents the panels from displacing in a direction along the joint edges when the panels are laying flat on the sub floor and are locked with the vertical and the first horizontal connections, wherein the mechanical locking system comprises a separate material, other than the material of the panel core, which is connected to the floorboard, wherein the separate material is aluminum.

* * * * *